US005638964A

United States Patent [19]

Ernst

[11] Patent Number: 5,638,964

[45] Date of Patent: Jun. 17, 1997

[54] WRENCH RACK

[76] Inventor: Gregory R. Ernst, 14735 SE. Bartell Rd., Boring, Oreg. 97009

[21] Appl. No.: 383,942

[22] Filed: Feb. 6, 1995

[51] Int. Cl.[6] ..... A47F 7/00

[52] U.S. Cl. ..... 211/70.6; 211/89; 248/316.7; 206/376; 206/377

[58] Field of Search ..... 211/69, 70.6, 89, 211/68; 248/113, 316.7; 206/376, 377, 379

[56] References Cited

U.S. PATENT DOCUMENTS

| | | | |
|---|---|---|---|
| D. 312,017 | 11/1990 | Gould | 6/553 |
| 1,141,060 | 5/1915 | Hobbs | 211/68 |
| 1,454,900 | 5/1923 | Leventry | 211/68 |
| 1,933,894 | 11/1933 | Clink | 206/376 X |
| 2,639,815 | 5/1953 | Paluck | 211/70.6 |
| 3,370,696 | 2/1968 | Groe | 211/70.6 X |
| 3,391,432 | 7/1968 | Du Rocher | 211/69 X |
| 3,827,152 | 8/1974 | Dailey | 211/69 X |
| 4,134,499 | 1/1979 | Joswig | 211/70.6 X |
| 4,485,578 | 12/1984 | Novey | 211/68 X |
| 4,619,364 | 10/1986 | Czopor, Jr. | 206/379 |
| 4,911,297 | 3/1990 | Suburu | 211/70.6 X |
| 4,961,505 | 10/1990 | Moeller | 211/69 X |
| 5,005,710 | 4/1991 | Hofer | 211/89 X |
| 5,020,666 | 6/1991 | Barlean | 211/70.6 X |
| 5,046,624 | 9/1991 | Murphy et al. | 211/70.6 |
| 5,255,799 | 10/1993 | Haynes | 211/68 |
| 5,275,367 | 1/1994 | Frye | 248/316.7 X |
| 5,346,063 | 9/1994 | Chow | 206/376 |

*Primary Examiner*—Alvin C. Chin-Shue
*Assistant Examiner*—Richard M. Smith
*Attorney, Agent, or Firm*—James D. Givnan, Jr.

[57] ABSTRACT

A wrench rack includes a base having spaced apart rows of arm structures with corresponding pairs of arm structures serving to support a set of wrenches. A flexible biasing member of each arm structure is displaced upon wrench installation in the rack and urges the wrench into frictional engagement with an adjacent arm structure to prevent inadvertent release of the wrench. A flexible biasing member is, in one embodiment, embodied in a span of material while a modified arm structure has a flexible biasing member embodied in a distal end segment of the structure.

2 Claims, 1 Drawing Sheet

WRENCH RACK

BACKGROUND OF THE INVENTION

The present invention pertains to a wrench rack for holding a set of wrenches in orderly fashion either on a wall surface, in a tool box, on a work bench, etc.,.

Wrench racks are in use to support a set of wrenches and facilitate wrench selection and storage. Such racks typically include rows of arms with corresponding pairs of arms supporting wrenches of the open end, box, combination, etc., types.

A drawback to known wrench racks is the inability of same to secure the wrenches against accidental displacement from the arms.

In the prior art is a U.S. Pat. No. 5,346,063 which discloses a rack wherein a wrench is supported by a pair of arms with a resilient member on the rack base urging the wrench into contact with a lip formed on each arm structure. Such a rack entails structure beyond what may be produced using high volume production methods to effect a rack having a low cost of manufacture. Further, the wrench when inserted or removed into the rack, requires wrench rotation about the major axis of the wrench.

SUMMARY OF THE PRESENT INVENTION

The present invention is embodied in a wrench rack wherein arm structures include means biasing the wrenches into contact with an adjacent arm structure to ensure wrench retention. The rack includes a base having oppositely disposed rows of arm structures with a pair of corresponding arm structures serving to grip a wrench thereon to prevent accidental dislodgement. The arm structures include yieldable members which flex to accommodate an inserted wrench handle. A barrier additionally serves to inhibit undesired wrench movement yet readily permits wrench separation when grasped by the user's fingertips. An open area in the arm structure permits flexure of a portion of same without reliance on additional components.

Important objectives of the present rack include the provision of a wrench rack lending itself to high volume production methods yet providing for wrench retention against all but intended forces to provide an orderly set of wrenches wherever the rack is located, e.g., tool box, wall surface, automobile trunk, etc.; the provision of a wrench rack wherein rows of arm structures are provided with yieldable components which flex under wrench imparted forces during wrench installation and removal and which components are homogeneous with the remainder of the rack.

DETAILED DESCRIPTION OF THE PREFERRED EMBODIMENTS

Figure 1:
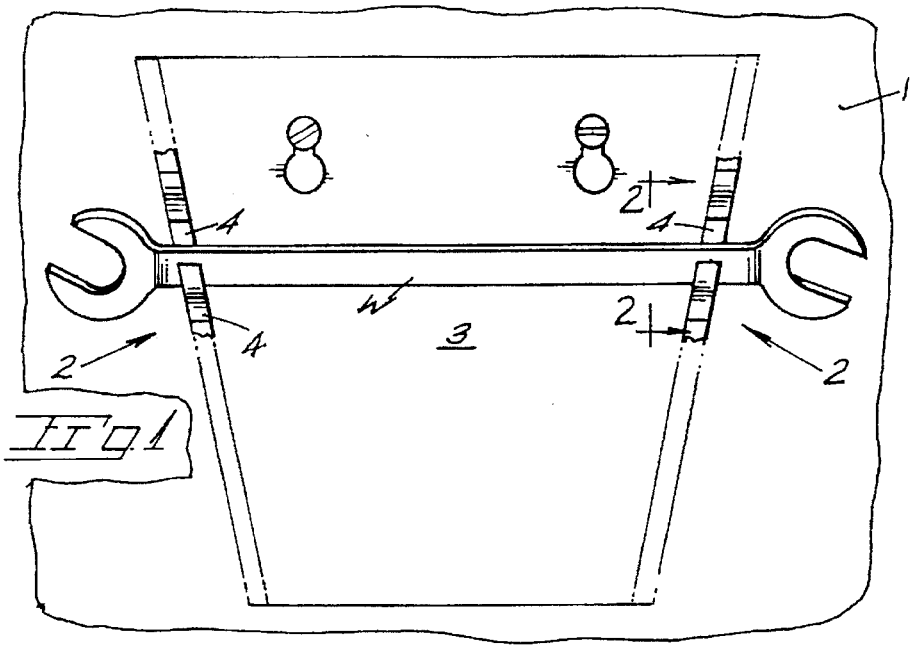
FIG. 1 is an elevational view of the present wrench rack on a wall surface.

With continuing attention to the drawings wherein applied reference numerals indicate parts similarly hereinafter identified, the reference numeral 1 indicates a wall surface on which the present rack may be supported. The rack is equally usable otherwise attached or free standing.

Figure 2:
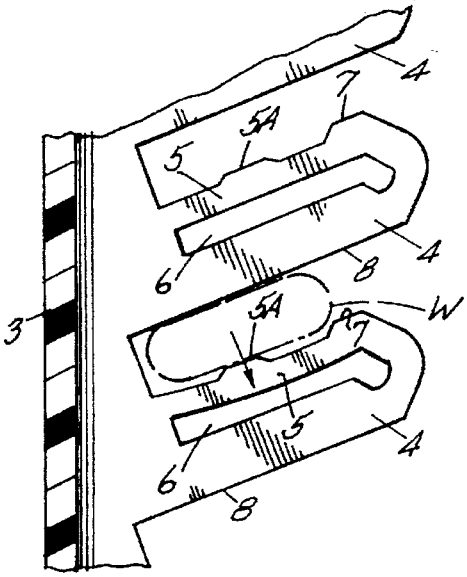
FIG. 2 is a vertical sectional view of a wrench rack arm structure taken along line 2—2 of FIG. 1.
Figure 3:
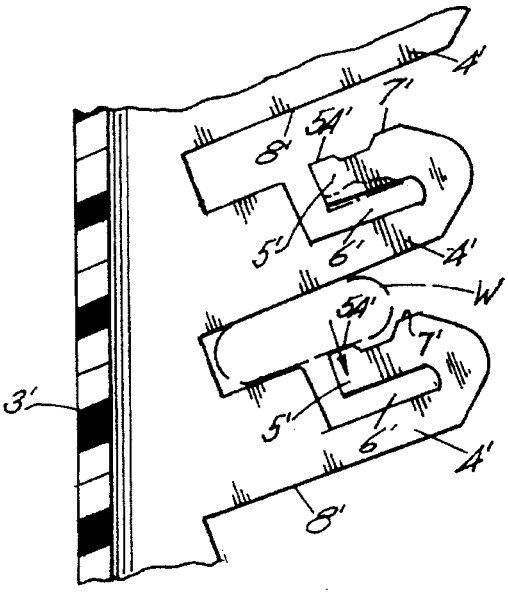
FIG. 3 is a view similar to FIG. 2 but showing a modified arm structure.

A rack arm structure is indicated generally at 2 while a rack base is at 3 which forms a web interconnecting rows of arm structures 2 for reception of a wrench handle W. With attention to an arm structure 2, the same includes a main member 4 and a flexible wrench biasing member 5 having a raised protruding surface 5A for wrench handle contact. A lengthwise oriented opening at 6 along the arm structure is defined by members 4 and 5 and a bridging member joining their distal portions and permits member 5 to be a span of material of reduced cross section which may yield upon advancement of the wrench handle W into arm structure engagement. A barrier at 7 of the arm structure is located adjacent the arm outer end so as to present a hinderance to wrench removal to the extent the wrench is retained against all but intentional removal efforts. The opening 6 may be of the closed type per FIG. 2 or the open type per FIG. 3 wherein the opening is indicated at 6' with the remaining portions of the modified arm structure being identified with prime reference numerals which correspond to the first described portions indicated with base reference numerals. Wrench biasing member 4' is a reversed end segment of the arm structure. Arrows indicate the direction of displacement of wrench biasing member 5 and 5' during seating of a wrench on the rack.

A lower surface 8 of each arm structure provides a surface along which a wrench handle slides during wrench insertion and removal. In a wrench rack for a set of wrench of different sizes, the size of the arm structures may vary.

While I have shown but a few embodiments of the invention, it will be apparent to those skilled in the art that the invention may be embodied still otherwise without departing from the spirit and scope of the invention.

Having thus described the invention, what is desired to be secured by a Letters Patent is:

I claim:

1. A rack for storing wrenches with handles, said rack comprising: a base having opposite sides; and two rows of aligned arm structures, said rows oppositely disposed on and projecting outwardly from the sides of said base, said arm structures being of like configuration, homogenous construction, and arranged in pairs with each of said pairs of arm structures adapted to receive a wrench handle, each of said arm structures comprising a first flexible biasing member with a proximate and a distal end, said first member having a raised surface for biasing contact with a wrench handle, a second member located below said first member, said second member having a proximate and a distal end, said proximate ends of said first and second members being adjacent said base, and a bridging member which connects said distal ends of said first and second members, said first, second, and bridging members of each said arm structure defining a lengthwise extending opening, said opening receiving said first flexible biasing member when the wrench is in biasing engagement with a top surface of said first member and a bottom surface of a second member of an adjacent arm structure.

2. A rack according to claim 1 further comprising a barrier at the distal end of said first flexible biasing member engageable with a wrench during removal of the wrench from the rack.

* * * * *